US005125228A

United States Patent [19]

Jewess et al.

[11] Patent Number: 5,125,228

[45] Date of Patent: Jun. 30, 1992

[54] DIAPHRAGM SEAL PLATE

[75] Inventors: Gordon F. Jewess; Phillip B. Vessa; R. G. Keetley, all of San Diego, Calif.

[73] Assignee: Sundstrand Corporation, Rockford, Ill.

[21] Appl. No.: 627,019

[22] Filed: Dec. 13, 1990

[51] Int. Cl.[5] ..... F02C 3/05; F02C 7/24

[52] U.S. Cl. ..... 60/39.36; 60/39.75

[58] Field of Search ..... 60/39.75, 39.31, 39.32, 60/39.36, 760; 417/406, 407; 415/177, 178, 170.1

[56] References Cited

U.S. PATENT DOCUMENTS

| | | | |
|---|---|---|---|
| 2,946,192 | 7/1960 | Hambling | 60/39.36 |
| 3,116,908 | 1/1964 | Wosika | 415/143 |
| 3,163,003 | 12/1964 | Paul et al. . | |
| 3,263,424 | 8/1966 | Birmann | 60/39.32 |
| 3,285,005 | 11/1966 | Morris . | |
| 3,285,006 | 11/1966 | Freeman et al. | 60/39.36 |
| 4,009,568 | 3/1977 | King et al. | 60/39.75 |
| 4,030,288 | 6/1977 | Davis et al. . | |
| 4,040,249 | 8/1977 | Kahle et al. | 60/39.31 |
| 4,712,370 | 12/1987 | MacGee . | |
| 4,932,207 | 6/1990 | Harris et al. | 60/39.32 |
| 5,033,263 | 7/1991 | Shekleton et al. | 60/39.36 |

FOREIGN PATENT DOCUMENTS

| | | | |
|---|---|---|---|
| 750597 | 6/1956 | United Kingdom | 415/177 |

*Primary Examiner*—Richard A. Bertsch
*Assistant Examiner*—Timothy S. Thorpe
*Attorney, Agent, or Firm*—Wood, Phillips, Mason, Recktenwald & VanSanten

[57] ABSTRACT

A first annular seal (46) is mounted on the housing (10) and extends into the space (32) between the compressor (26) and the turbine wheel (16). The seal (46) includes a main sealing and support section (54) adjacent the compressor (26) and an insulating section (86) adjacent the turbine wheel (16). The insulating section (86) is mounted on and generally spaced from the main support section (54). A peripheral groove (66) opens axially towards the turbine wheel (16) and is located at a radially outer extremity of the first seal (46). The groove (66) includes a first and second wall, with the first wall (70) located radially inward of the second wall (78). A mounting element (68) is attached to a radially inward side (69) of the first wall (70) to form a gap (75) between the first wall (70) and the mounting element (68). A second annular seal (74) includes an inner and outer edge. The inner edge (73) is sealingly engaged in the gap (75) and the second edge (79) is secured between a turbine side of the second wall (78) and the housing support (10).

11 Claims, 4 Drawing Sheets

DIAPHRAGM SEAL PLATE

FIELD OF THE INVENTION

This invention relates to turbine engines, and more particularly, to seals utilized to isolate the compressor and turbine sections of turbine engines having centrifugal compressors and radial turbines.

BACKGROUND OF THE INVENTION

In many turbine engines of the type utilizing centrifugal compressors coupled to radial turbines, the compressor and the turbine wheel are located in back-to-back relationship for compactness. Usually, an annular, narrow space exists between the two for thermal isolation purposes. That is, the space is provided to prevent undue quantities of heat from being transmitted from the turbine wheel to the compressor as a result of heating of the turbine wheel by hot gases of combustion.

While the space achieves such an objective, it presents a difficulty in that it must be sealed to prevent the flow of gas between the compressor side of the machine and the turbine side of the machine through such space at the interface between the rotor and the stator of the machine. Further, the sealing of such space should be such that the seal itself does not transmit unduly large quantities of heat from the turbine side of the engine to the compressor side.

To solve this difficulty, it has been conventional to provide an annular seal made up of two components. A first component is a forward seal plate which is secured by any suitable means to the engine stator on the compressor side thereof and which extends into the space between the compressor and the turbine into almost touching relation to the boundary of the space at its radially inner extremity. This seal plate holds down passage of gas from the compressor side to the turbine side of the engine to some desired amount (frequently, a small amount of gas passage is preferred to provide for some rotor cooling). However, it is not capable of preventing heat transfer from the turbine side of the engine to the compressor side.

In order to minimize such heat transfer, prior art seals additionally include a so-called diaphragm which is a relatively thin, ring-shaped piece of metal which is mounted on a forward seal plate near its radially outer periphery and extends radially inwardly therefrom to have its radially inner edge suitably mounted to the seal plate. The main body of the diaphragm is spaced from the seal plate thereby establishing an air pocket between the two which severely impedes heat transfer from the turbine side of the engine to the compressor side.

During engine operation, extremely high temperatures are generated at the turbine side of the engine. As a consequence, the seal plate and the diaphragm are subjected to thermal cycling and the diaphragm in particular experiences significant thermal growth in the process. Furthermore, there is a substantial thermal gradient radially across the seal assembly. These two factors result in distortion of the diaphragm during various operating conditions and will cause cracking leading to eventual failure. In order to prevent such distortion from resulting in interfering contact between the turbine wheel and the diaphragm, the clearance between the two must be kept relatively large. And, of course, utilizing a relatively large clearance increases the leakage flow path around the seal plate. The natural result is, of course, increased leakage and decreased operational efficiency of the machine.

Commonly assigned U.S. Pat. No. 4,932,207, issued Jun. 12, 1990 to Harris et al., discloses a highly desirable seal design which minimizes the clearance between the seal plate and turbine while providing an isolation space between the two to prevent heat transfer and accommodating the thermal cycling of the seal. The seal design minimizes to some extent the hot gas which enters the dead air space at the point where a three-layer laminate abuts an axial face on the forward seal plate and the housing support adjacent the annular nozzle. The present invention is directed at improving the insulating effects of the Harris et al. seal while continuing to minimize the amount of gas leakage.

SUMMARY OF THE INVENTION

It is the principal object of the invention to provide a new and improved turbine engine. More specifically, it is an object of the invention to provide a turbine engine of the centrifugal compressor-radial turbine type with a seal plate having a diaphragm located thereon whereby clearance between the seal plate and the turbine and leakage of the hot gas through the seal plate are both minimized to reduce performance losses.

An exemplary embodiment of the invention achieves the foregoing object in a turbine engine including a centrifugal compressor and a radial turbine wheel. Means couple the compressor and the turbine wheel in slightly spaced, back-to-back relation so that the turbine wheel may drive the compressor. A housing surrounds the compressor and the turbine wheel and a stationary seal is mounted on the housing. The stationary seal extends into the space between the compressor and the turbine wheel and includes a main sealing and support section adjacent the compressor and an insulating section adjacent the turbine wheel. The insulating section is mounted on the main sealing and support section. A peripheral groove opens axially towards the turbine side and is located axially mid-way along the main sealing and support section. The peripheral groove includes a radially opening gap. An annular diaphragm seal extends from the gap to a radially opposite side of the groove and acts to seal the insulating section to the main sealing and support section.

In a preferred embodiment, the diaphragm seal is held in place by a biasing force that a spring means exerts on the main sealing and support section. Thus, the diaphragm seal is pinched between the radially opposite side of the groove and the housing support and defines a first dead air space. Preferably, the insulating section comprises a plurality of segments disposed in a circular array and angularly movable with respect to each other together with a means sealing adjacent segments to each other.

In another preferred embodiment, the gap is defined by an L-shaped annular support on the associated side of the groove. The intersection of main sealing and support section, the L-shaped annular support, and the segments enclose a second dead air space.

A third dead air space is enclosed by the housing support, the segments, the diaphragm seal and the L-shaped annular support. The three dead air spaces insulate the compressor side from the hot gas on the turbine side.

As a result of the foregoing, three dead air spaces for thermal isolation are provided while the segments are permitted to grow thermally in the circumferential and radial directions. Because the segments are movable with respect to each other, the thermal growth may be accommodated without distortion and clearance at the turbine wheel may be absolutely minimized. Furthermore, any hot gas which might pass beyond a first seal formed by the turbine side of the radially outer end of one of the segments where it abuts the housing support adjacent the annular nozzle is impeded in its travel by the diaphragm seal and the third seal formed by the L-shaped support where it abuts the compressor side of the radially outer end of the same segment. Even though the gas may permeate the first seal, the dead air spaces surrounding the first seal insulate the compressor side from the temperature of the hot gas. As a result, more efficient engine operation can be achieved.

Other objects and advantages will become apparent from the following specification taken with the accompanying drawings.

DESCRIPTION OF THE PREFERRED EMBODIMENT

Figure 1:
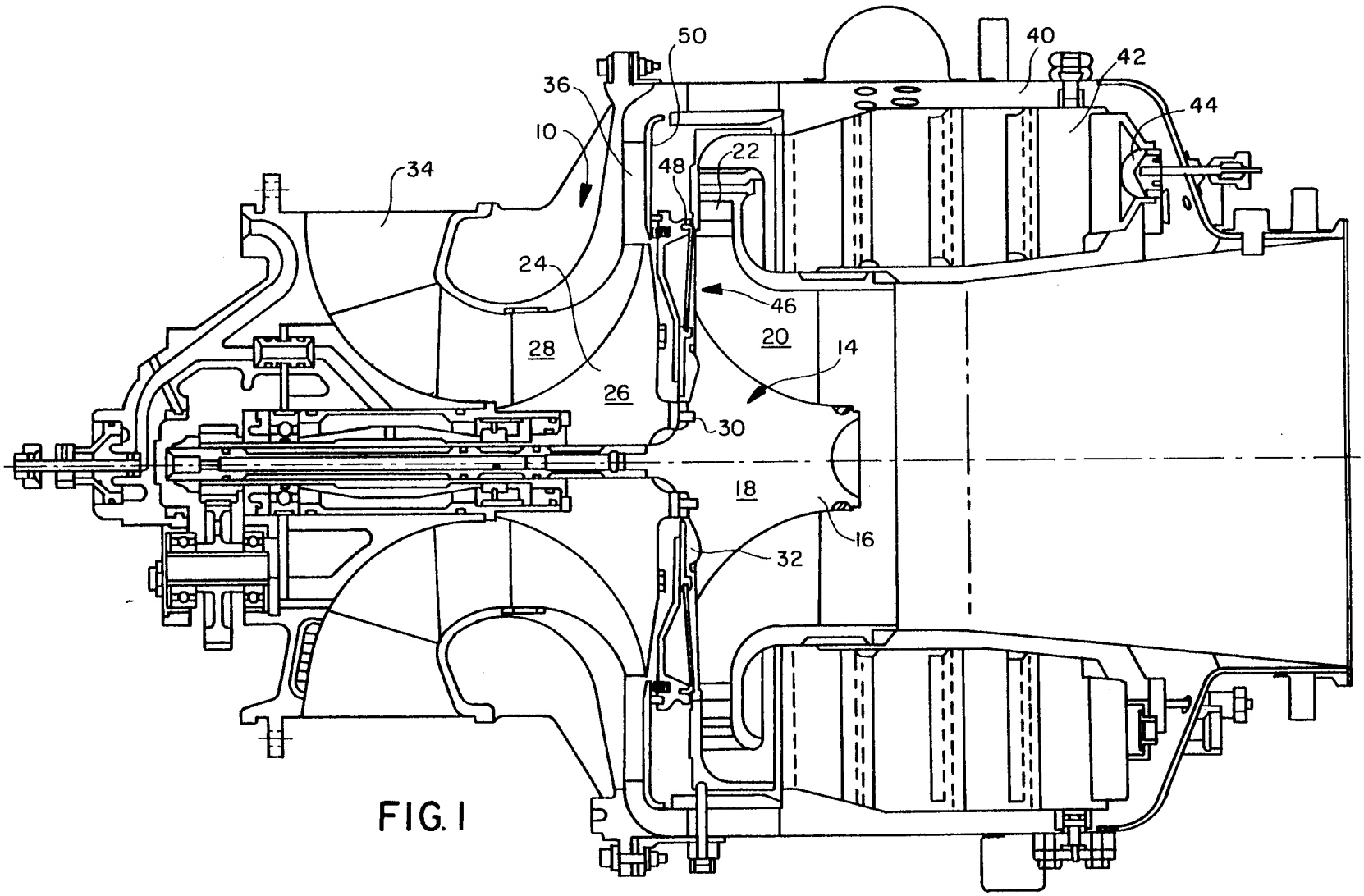
FIG. 1 is a sectional view of a gas turbine engine made according to the invention.

An exemplary embodiment of a gas turbine engine that may be provided with a seal plate according to the invention is illustrated in FIG. 1 and is seen to include a stationary housing, generally designated 10. Journalled within the housing for rotation about an axis 12 is a rotor, generally designated 14. The rotor 14 in turn is made up of a radial turbine wheel 16 having a hub 18 and blades 20 located to receive hot gases of combustion directed radially inward by an annular nozzle 22. The rotor 14 further includes a rotary, centrifugal compressor 24 including a hub 26 and peripheral blades 28. The turbine wheel 16 and compressor 24 are coupled together by any suitable means including, for example, pins 30, for conjoint rotation. It will be observed that a radially inward directed, annular space 32 exists between the turbine wheel 16 and the compressor 24.

During operation, the air from an inlet 34 to the machine is compressed by the blades 28 and directed radially outwardly through a diffuser 36. Compressed air is then passed through an annular plenum 40 which surrounds an annular combustor 42. Air is admitted to the interior of the combustor 42 as is well known combined therein with fuel injected by injectors 44 to produce gases of combustion. The combustor 42 includes an outlet in fluid communication with the nozzle 22.

To seal the area between the diffuser 36 and the nozzle 22 as well as the space 32, a seal assembly, generally designated 46, is utilized. The seal assembly 46 may be mounted on a part 50 of the housing by conventional means.

Figure 2:
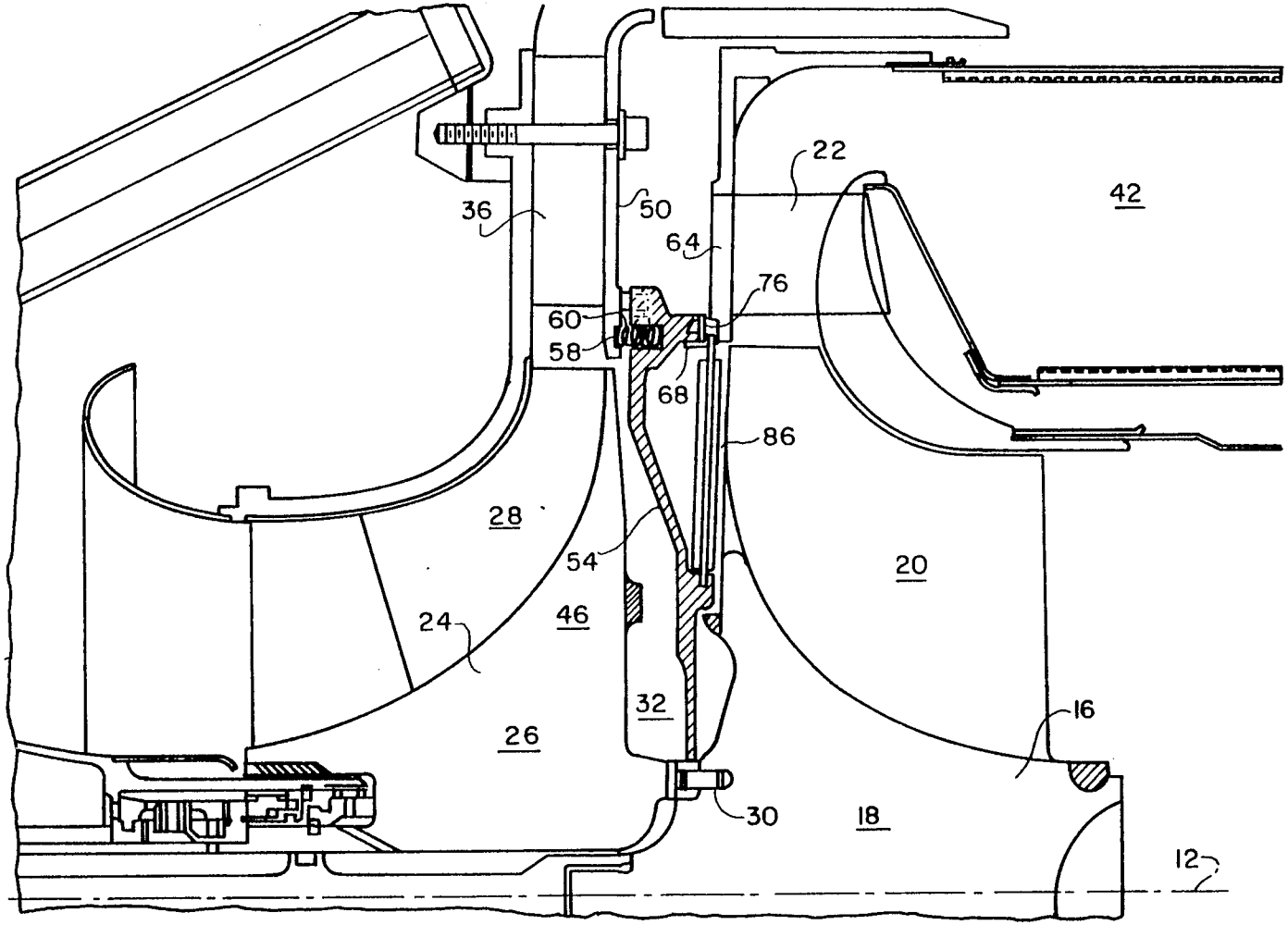
FIG. 2 is an enlarged, fragmentary sectional view of the stator-rotor interface of such engine.
Figure 2B:
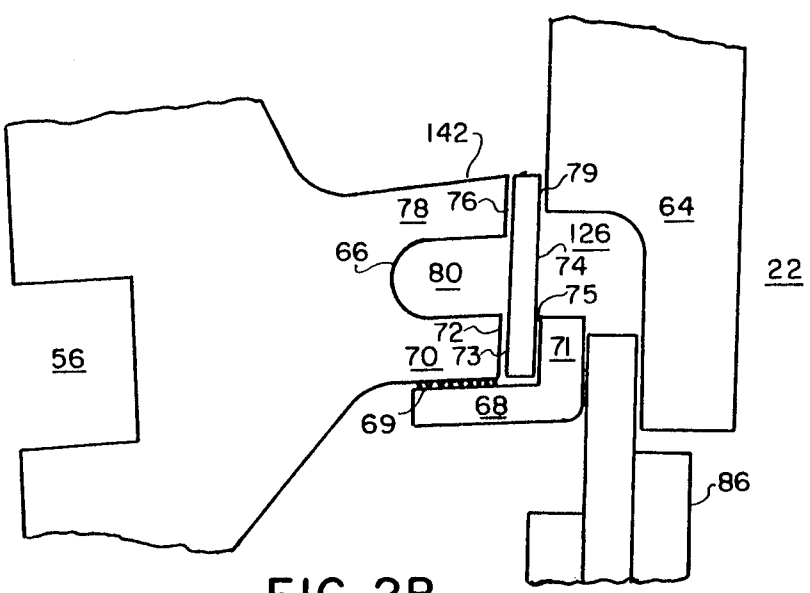
FIG. 2B is an enlarged view showing the diaphragm seal of FIG. 2.
Figure 2C:
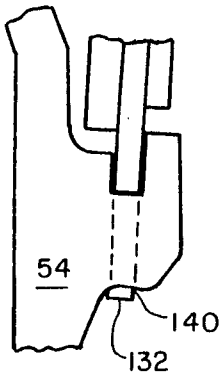
FIG. 2C is an enlarged view showing the radially inward portion of the segments of FIG. 2.
Figure 2A:
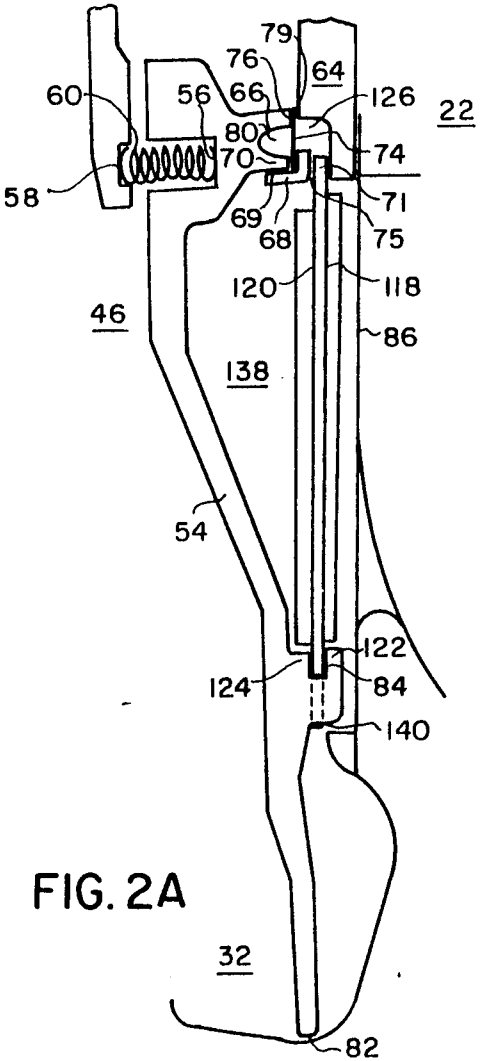
FIG. 2A is an enlarged view of the forward seal plate of FIG. 2.

Addressing FIGS. 2, 2A and 2B, each seal assembly 46 may be seen to be made up of four basic components. The first component is a forward seal plate 54 which is ring-like in configuration and which is disposed between the compressor 26 and the turbine wheel 16 The forward seal plate 54 is the component that is mounted to the housing 10 and which mounts the other components of the seal assembly 46. A first peripheral groove 56 opening axially towards the compressor 26 is located at a radially outer extremity of the forward seal plate 54. A second peripheral groove 58 is located on the housing 10 adjacent the first groove 56 and opens axially towards the turbine wheel 16. A bellows-like spring 60 is located in the first and second grooves 56, 58 and respectively seals the forward seal plate 54 against the housing support 64, preferably adjacent the annular nozzle 22. While a bellows-like spring 60 is preferred, any means that will seal the forward seal plate 54 against the housing 10 and provide a biasing force against the forward seal plate 54 is contemplated. The forward seal plate also includes a third peripheral groove 66 which opens axially toward the turbine wheel 16 and is located radially inward from the first groove 56. The second basic component is a diaphragm seal construction and includes an L-shaped annular support ring 68 which is secured to the radially inner side 69 of the radially inner wall 70 defining the groove 66. The third basic component, the L-shaped support 68 has a first section 71 substantially aligned with an end 72 of the radially inward wall 70 of the groove 66. The radially inner edge 73 of a diaphragm seal 74 is sealingly received in an annular, radially outwardly opening gap 75 formed by the L-shaped support 68 and the end 72. The bias that spring 60 exerts on the forward seal plate 54 urges an end 76 of the radially outer wall 78 defining the groove 66 into sealing contact with the radially outer edge 79 of the diaphragm seal 74 which, in turn, is biased into sealing contact with the stationary housing support 64 adjacent the annular nozzle 22. Thus a first annular dead air space 80 is formed between the base of the third groove 66 and the diaphragm seal 74.

The forward seal plate 54 includes a radially inner, circular edge 82 which is in close proximity to the interface of the turbine wheel 16 and the compressor 24, that is, the radially inner boundary of the space 32. Approximately radially midway along the forward seal plate 54 lies a radially outwardly opening fourth annular groove 84.

Figure 3:
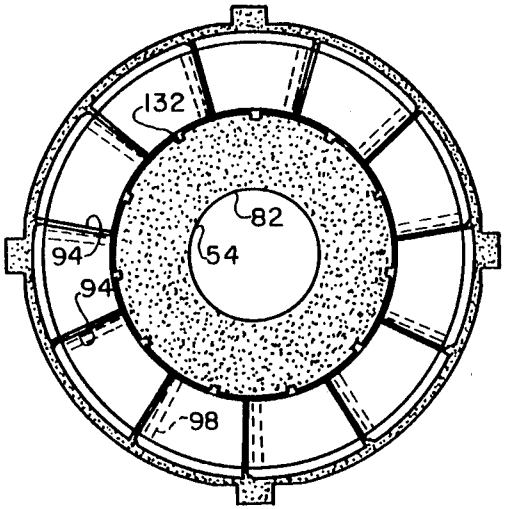
FIG. 3 is a plan view of an assembled seal plate made according to the invention.

The fourth basic component of the seal assembly 46 is a plurality of segments 86 arranged in a circular array as seen in FIG. 3. The segments 86 may be regarded as somewhat pie-shaped or even trapezoidal with arcuate major and minor bases. The segments 86 are mounted to the forward seal plate 54 on the turbine side of the engine near the radially outer periphery of the turbine 16.

In a preferred embodiment, the segments 86 are made up of a three-layer laminate as more fully explained in the previously identified Harris et al. patent, the details of which are herein incorporated by reference. One layer 88 faces and is immediately adjacent the turbine wheel 16. Two other layers 90 and 92, respectively, constitute a support sheet and, as can be seen from FIGS. 4 and 5, they are offset from one another. Generally, though not necessarily, the layers 88, 90 and 92 will all be made of the same material to avoid the generation of stresses that are associated with thermal growth of different materials which may have differing coefficients of thermal expansion. In addition, the total arc length of the corresponding segments is never equal to 360° although that number is approached. As a consequence, and as seen in FIG. 3, the side edges 94 and 96 of the layer 88 do not touch each other, to allow for thermal growth in the circumferential direction. The same relationship exists between the side edges 98 and 100 of the layer 90 and the side edges 102 and 104 of the layer 92.

In another preferred embodiment, the radially inner edges 106, 108, 110 of the three layers 88, 90, 92 respectively are not aligned. Similarly the radially outer edges 112, 114, 116 of the three layers 88, 90, 92 respectively are not aligned. The radially inner edge 108 of layer 90 is positioned in the base of the fourth groove 84. A turbine side face 118 of the layer 90 abuts the housing support 64 at the radially outer end of the layer 90 to cause the layer 90 to sealingly engage with the housing support 64, preferably adjacent the annular nozzle 22. Additionally, a compressor side face 120 preferably sealingly engages the L-shaped support 68. The spring 60 urges the front seal plate 54 towards the turbine to maintain the sealing engagement between L-shaped support 68, the two faces 118, 120 of the layer 90, and the housing support 64.

The layer 88 extends in a radial direction approximately from the turbine side tip 122 of the fourth groove 84 into close proximity to the radially innermost portion of the housing support 64. The layer 92 extends in a radial direction from approximately the compressor side tip 124 of the fourth groove 84 to a close proximity to the housing support 64. A second annular dead air space 126 is formed and is bounded by the diaphragm seal 74, the housing support 64, the L-shaped support 68, and the faces 120 and 122 of the layer 90.

The side edges 96 and 104 of the layers 88 and 92 are aligned as are the side edges 94 and 98 of those layers. Conversely, the side edge 98 of the layer 90 is angularly recessed from the edges 94 and 102 while the side edge 100 of the layer 90 extends angularly past the edges 96 and 104.

Figure 5:
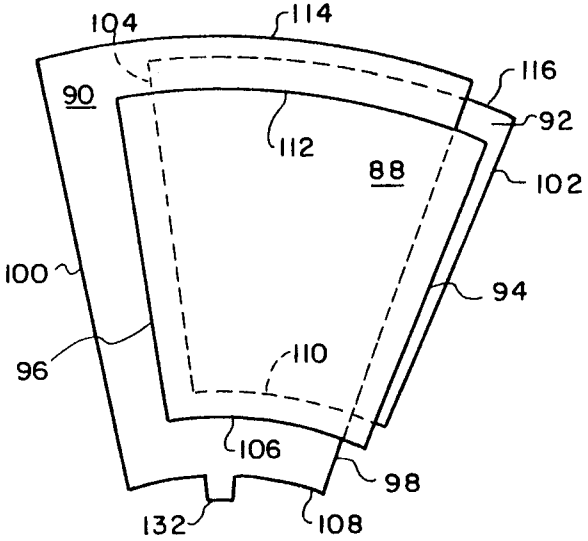
FIG. 5 is an exploded view of the segment.
Figure 4:
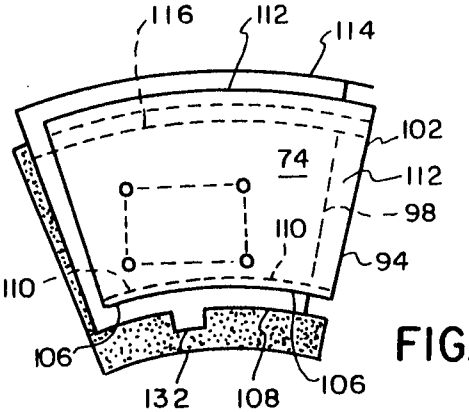
FIG. 4 is a plan view of a segment utilized in the seal plate.

As a result, a circumferentially opening groove 128 is located on the right hand side of each of the segments 86 and a circumferentially projecting tongue 130 on each segment 86 is defined by that part of the layer 90 along its left hand edge as viewed in FIGS. 4 and 5. The tongue 130 is sized to be slidably received in the groove 128 in the adjacent segment and essentially seals the interface between the two.

The radially inner edge 108 of the layer 90 may include a central, radially inwardly protruding pin 132. The layer 90 engages between tips 122, 124 of the fourth groove 84 to seal at that location.

By forming the forward seal plate 54 to be slightly concave on its surface 134 facing the turbine side of the engine, a third annular dead air space 138 (FIG. 2A) sealed in the manner mentioned previously is provided.

The pins 132 mounted to the layer 90 may be disposed in slots 140 formed in the base of fourth groove 84 to limit movement of the segments 86 in the circumferential direction so that they do not all "bunch up" at one location on the ring assembly while allowing thermal growth of the segments 86 in the radial direction. Of course, it is not necessary that all of the segments 86 be provided with the pins 132 for the slots 140.

While a separate L-shaped annular support 68 is disclosed, a design integrating the annular L-shaped support 68 with the wall 70 of the forward seal plate's 54 third peripheral groove 66 is also contemplated. Furthermore, attaching the L-shaped annular support 68 to a radially outer side 142 of the wall 78 is also contemplated.

It will be readily appreciated that a seal assembly 46 made according to the invention utilizing the segments 86 permits circumferential expansion of that boundary of the dead air space 138 facing the turbine side of the engine. The tongue and groove connection at the bottom edges of the segments to the forward seal plate 54 and the pinned connections at the upper end thereof also provide for expansion in the radial direction. The tongue and groove connection to adjacent segments accommodates thermal growth in the circumferential direction thereby relieving hoop stress and eliminating the resulting cracking. Because the side of the seal assembly 46 is broken into two sections, i.e., the section defined by the segments 86 and the section defined by the forward seal plate 54, and the two sections are relatively movable with respect to one another, distortions due to thermal gradients in the radial direction are likewise avoided. As a consequence, the clearance between the layer 88 and the turbine wheel 16 may be minimized thereby reducing the size of the leakage path between the turbine and seal plate, thus increasing engine efficiency.

Furthermore, due to the thermal growth of the various elements of the seal, three dead air spaces are provided to further prevent the hot gases on the turbine side from affecting the temperature of the gas on the compressor side. More specifically, hot gases which pass through the seal formed by the turbine side face 118 of the layer 90 where it abuts the housing support 64 adjacent the annular nozzle 22 may enter a second dead air space 126. The hot gases must then permeate the diaphragm seal 74 and/or the seal formed by the surface 120 of the layer 90 and the L-shaped member 68 to significantly affect the temperature of the surface 134 of the forward seal plate 54. Thus, the temperature of the compressor air will be minimized to increase the engine efficiency while the clearance between the layer 88 and turbine wheel 16 are still minimized.

We claim:

1. A gas turbine engine having a compressor side and a turbine side and comprising:

a centrifugal, rotary compressor having a gas flowing therethrough;

a radial turbine wheel including an annular nozzle;

means coupling the compressor and the turbine wheel in slightly spaced, back-to-back relation so that the turbine wheel may drive the compressor;

a housing surrounding the compressor and the turbine wheel and including a housing support;

a first annular seal mounted on the housing and extending into the space between the compressor and the turbine wheel, the seal including a main sealing and support section adjacent the compressor and an insulating section adjacent the turbine wheel and mounted on but generally spaced from the main support section;

a peripheral groove opened axially towards the turbine side and located at a radially outer extremity of the first seal, the groove having a first and second wall, the first wall located radially inward of the second wall;

a mounting means on the peripheral groove forming a radially outwardly opening gap; and a second annular seal means having an inner and outer edge, the inner edge being sealingly engaged in the gap and the outer edge secured between a turbine side of the second wall and the housing support.

2. The gas turbine engine of claim 1 wherein the insulating section includes a plurality of segments disposed in a circular array and angularly movable with respect to each other, and a means sealing adjacent segments to each other.

3. The gas turbine engine of claim 2 wherein a bottom portion of the insulating section is mounted in a radially outwardly opening groove located approximately radially midway along the main section, the radially outwardly opening groove having a base, and a third and fourth wall, the base is located midway between the third and fourth wall.

4. The gas turbine engine of claim 3 wherein the radially outwardly opening groove located on the main section includes a slot located in the base of the groove and the insulating section includes a pin located on a radially inner edge of a segment, wherein when the slot and the pin are engaged, the angular movement of the segments is limited.

5. The gas turbine of claim 1 wherein the annular nozzle lies adjacent the housing support.

6. The gas turbine engine of claim 1 wherein a spring means is located between the compressor side of the main sealing and support section and the housing for providing a bias against the main sealing and support section in a direction towards the turbine side; the bias of the spring means seals the turbine side of the second wall of the peripheral groove against the second annular seal and the stationary housing support, the mounting means against the segments and the segments against the stationary housing support.

7. The gas turbine of claim 1 wherein the mounting means is integrally formed with the peripheral groove of the first seal.

8. The gas turbine of claim 1 wherein the mounting means includes an L-shaped support attached to a radially inward side of the first wall.

9. The gas turbine of claim 1 wherein the mounting means includes an L-shaped support attached to a radially outer side of the second wall.

10. A gas turbine engine having a compressor side and a turbine side comprising:

a radial outflow, rotary compressor;

a radial inflow turbine wheel including an annular nozzle having a hot gas flowing therethrough;

means coupling the compressor and the turbine in slightly spaced, back-to-back relation so that the turbine wheel may drive the compressor;

a housing surrounding the compressor and the turbine wheel and including a housing support;

an annular seal mounted on the housing and extending into the space between the compressor and the turbine wheel, the seal including a main sealing and support section adjacent the compressor and an insulating section adjacent the turbine wheel and mounted but generally spaced from the main support section, the main insulating section comprising a plurality of segments disposed in a circular array and angularly movable with respect to each other, and a means sealing adjacent segments to each other;

a peripheral groove opened axially towards the turbine side and located at a radially outer extremity of the first seal, the groove having a base and first and second walls, the first wall located radially inward of the second wall;

an L-shaped mounting means attached to a radially inward side of the first wall to form a gap between the turbine side of the first wall and the L-shaped mounting means;

a diaphragm seal having an inner and outer edge, the inner edge being sealingly engaged in the gap and the second edge secured between a turbine side of the second wall and the housing support;

a spring means located between the compressor side of the main sealing and support section and the housing for providing force against the main sealing and support section the force directed towards the turbine side to seal the turbine side of the second wall of the peripheral groove against the diaphragm seal means and the housing support and to seal the L-shaped mounting means against the segments and housing support adjacent the annular nozzle;

a first dead air space enclosed by the base of the peripheral groove, the first and second walls of the peripheral groove, and the diaphragm seal;

a second dead air space enclosed by the segments and the main sealing and support section; and a third dead air space enclosed by the seal between the L-shaped member, the segments, the housing support, and the diaphragm seal;

whereby any hot air gas that leaks through the seal formed by the segments and the housing support adjacent the annular nozzle and that enters the third dead air space is insulated from the compressor by the first and second dead air spaces.

11. The gas turbine of claim 10 further including a restricting means on the insulating segments and the main sealing and support section for limiting angular movement of the segment on the main sealing and support section.

* * * * *